US007789010B2

(12) United States Patent
Allor et al.

(10) Patent No.: US 7,789,010 B2
(45) Date of Patent: Sep. 7, 2010

(54) ADJUSTABLE LOUVERED ARMOR WINDOW SYSTEM

(75) Inventors: Richard L. Allor, Livonia, MI (US); Michael K. Benjamin, Germantown, TN (US); David A. DeTroyer, Romulus, MI (US); James C. LaLonde, Farmington Hills, MI (US); Terry R. Peckham, Waterford, MI (US); Alan J. Peleshok, Livonia, MI (US); Dainius E. Skiotys, Farmington Hills, MI (US)

(73) Assignee: Ceradyne, Inc., Costa Mesa, CA (US)

( * ) Notice: Subject to any disclaimer, the term of this patent is extended or adjusted under 35 U.S.C. 154(b) by 96 days.

(21) Appl. No.: 11/893,461

(22) Filed: Aug. 15, 2007

(65) Prior Publication Data

US 2009/0044694 A1 Feb. 19, 2009

(51) Int. Cl.
*F41H 5/00* (2006.01)

(52) U.S. Cl. ..... 89/36.03; 89/36.01; 89/36.04; 89/36.08; 89/36.14; 49/51; 49/64

(58) Field of Classification Search ..... 89/36.01, 89/36.03, 36.08, 36.09, 36.14, 36.04, 36.12; 49/51, 64

See application file for complete search history.

(56) References Cited

U.S. PATENT DOCUMENTS

| | | | | |
|---|---|---|---|---|
| 4,694,608 | A * | 9/1987 | Lambert | 49/50 |
| 5,619,821 | A * | 4/1997 | St. George et al. | 49/57 |
| 6,647,857 | B1 * | 11/2003 | Newkirk | 89/36.08 |
| 2006/0162538 | A1 * | 7/2006 | Pfennig et al. | 89/36.08 |

* cited by examiner

*Primary Examiner*—Stephen M Johnson
*Assistant Examiner*—Daniel J Troy
(74) *Attorney, Agent, or Firm*—Leonard Tachner

(57) ABSTRACT

The adjustable louvered armor window system invention comprises angled louvers made of the lightweight opaque armor. For the front window a viewing window of ballistic glass can be installed, the rear or sides could be solid armor. The louvers have overlaps to provide for gap protection. When no threat is present, the louvers are in the full open position. Once a threat is detected, then the louvers are closed. The movement of the louvers can be accomplished by a push/pull cable, hydraulic pressure, air pressure or other means. The system in the fully open position allows for a complete unobstructed viewing area. In the semi-deployed or partial down position, the system provides partial ballistic coverage for the occupant, and still allows for some occupant vision capability. In the fully deployed, or fully closed position, the system provides full ballistic coverage for the occupant, with a small viewing area or port, which is made of ballistic grade transparent armor.

2 Claims, 3 Drawing Sheets

ADJUSTABLE LOUVERED ARMOR WINDOW SYSTEM

BACKGROUND OF THE INVENTION

1. Field of the Invention

The present invention relates generally to the field of window armor and more particularly to a relatively lightweight window armor solution that is especially useful for vehicles and boats. Moreover, the present invention pertains to window armor that still permits full use of the existing standard production glass window when no threat is present.

2. Background Art

Ballistic-resistant transparent glass is inherently heavier than opaque armor for the same threat level. Thus, the traditional method for providing protection for threats on windows, which requires ballistic glass, can be quite thick and heavy due to the amount of glass needed to stop the threat. In most installations, the production glass is removed and replaced with ballistic glass. Most ballistic glass systems are stationary and can't be opened. Alternatively, they may be provided with motors and special support structure to enable moving the glass up and down or back and forth to open and close the windows. Thus, in addition to the added weight of the ballistic glass, in order to enable one to open a window, there is still more weight for extra motors and special support structure. Such significant added weight is especially disadvantageous on a boat where the added weight may affect speed and balance.

Thus, there is a need to find a way to protect window areas from ballistic threats, which does not unduly add weight and/or make the windows un-openable, especially for boats, which may be readily affected by added weight.

SUMMARY OF THE INVENTION

The present invention solves the aforementioned need by protecting windows with opaque armor plates that are nominally positioned to allow use of the original standard glass, plexiglass or other transparent windows.

The spring assisted articulating window armor system is a system, which is mounted to the inside of vehicle leaving the original transparent glass in place and intact.

The adjustable louvered armor window system invention comprises angled louvers made of the lightweight opaque armor. For the front window a viewing window of ballistic glass can be installed, the rear or sides could be solid armor. The louvers have overlaps to provide for gap protection. When no threat is present, the louvers are in the full open position. Once a threat is detected, then the louvers are closed. The movement of the louvers can be accomplished by a push/pull cable, hydraulic pressure, air pressure or other means.

The system in the fully open position allows for a complete unobstructed viewing area. In the semi-deployed or partial down position, the system provides partial ballistic coverage for the occupant, and still allows for some occupant vision capability. In the fully deployed, or fully closed position, the system provides full ballistic coverage for the occupant, with a small viewing area or port, which is made of ballistic grade transparent armor.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
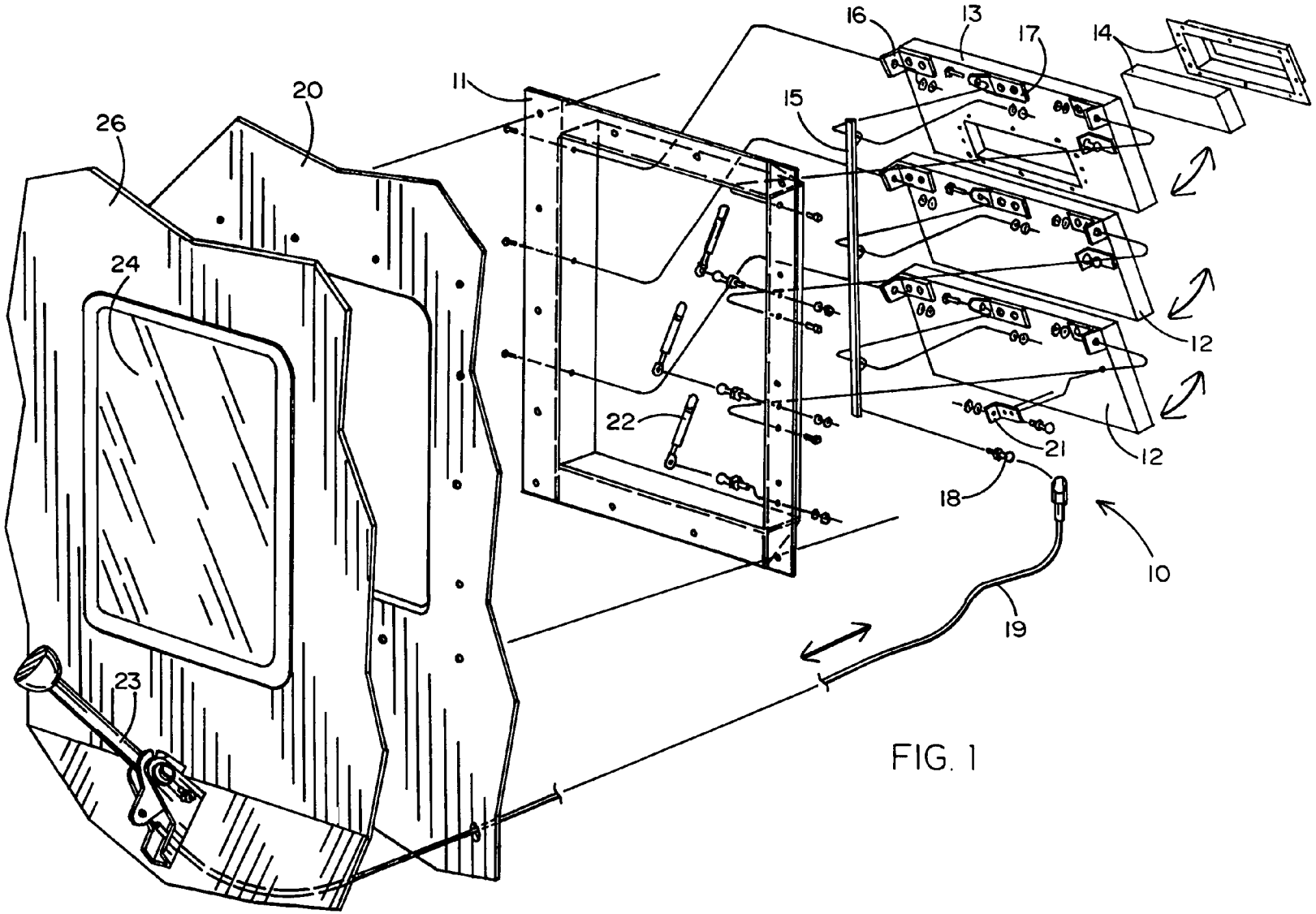
FIG. 1 is an exploded view of a preferred embodiment of the present invention shown with a conventional vehicle window.
Figure 2:
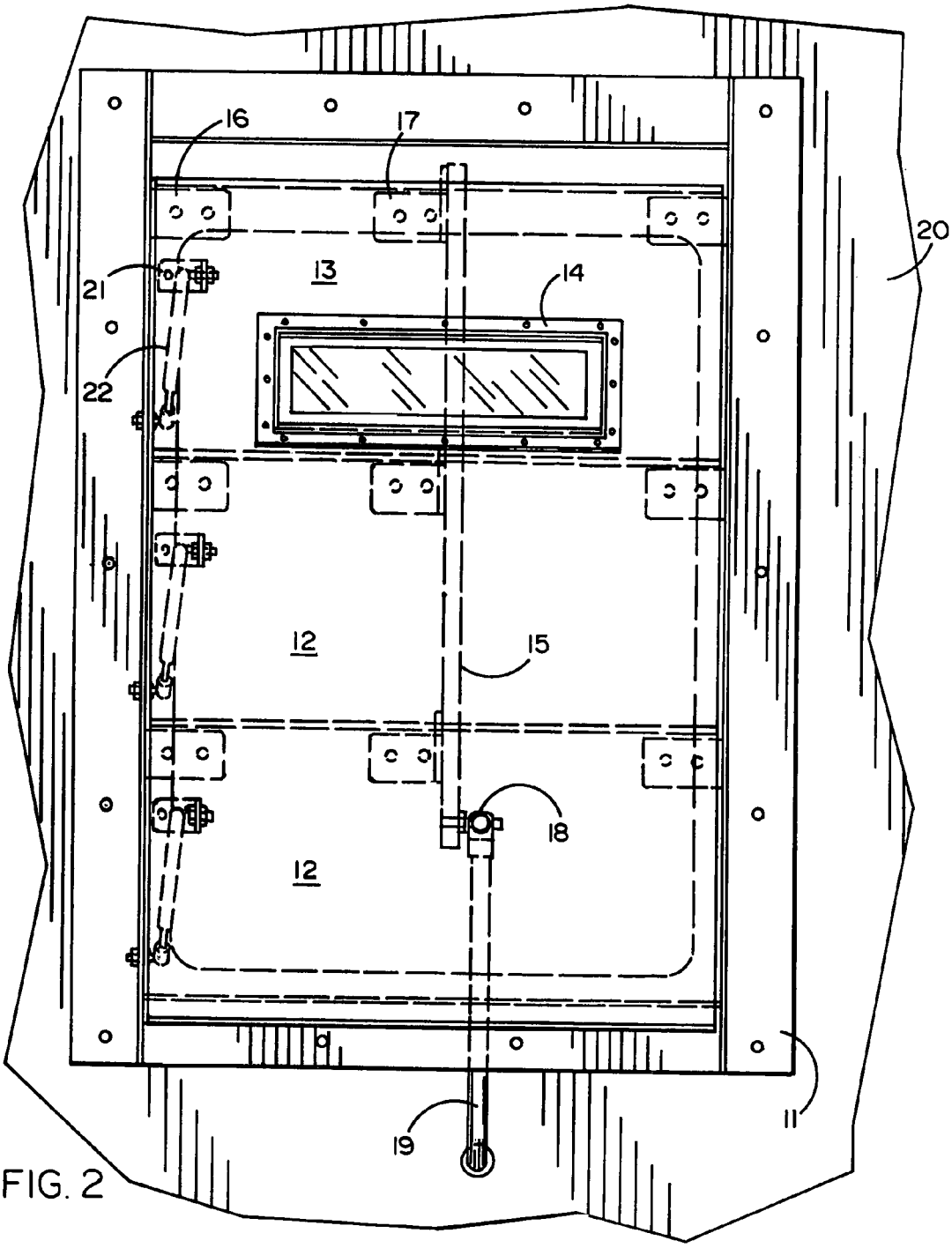
FIG. 2 is a front view of the preferred embodiment.

Referring to the accompanying drawings and initially to FIG. 1, it will be seen that an adjustable louvered armor window system 10 is shown therein in a partially open position. The preferred embodiment depicted in the accompanying figures comprises a frame assembly 11 in which there are installed a plurality of louvered opaque armor panels 12, the upper most one of which (panel 13) has a small armor glass and frame assembly 14 to permit one to see through the closed system.

Panels 12 and 13 are arranged for louvered operation using a rotating armor control rod 15 in conjunction with brackets 16 and 17. Control rod 15 is operated by push/pull control cable 19 using ball studs 18. Cable 19 is connected to a high capacity push/pull lever 23 mounted on the interior vehicle or boat body wall 26 immediately below the existing vehicle or boat window 24 to which an outer vehicle or boat armor body is attached in surrounding relation to the frame 11.

A gas spring 22 is attached between each panel and the frame using a corresponding bracket 21 and ball studs 18. The gas springs act to assist the opening of the armor panels to reduce the force that needs to be exerted by lever 23 and overcome the weight of the panels in lifting them into their open configuration.

Figure 4:
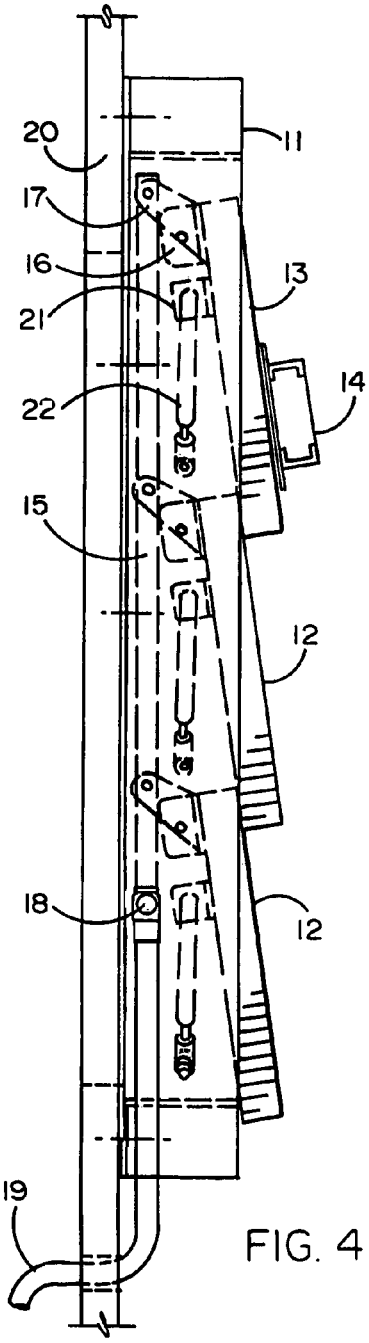
FIG. 4 is a side view in an armor-closed position.
Figure 3:
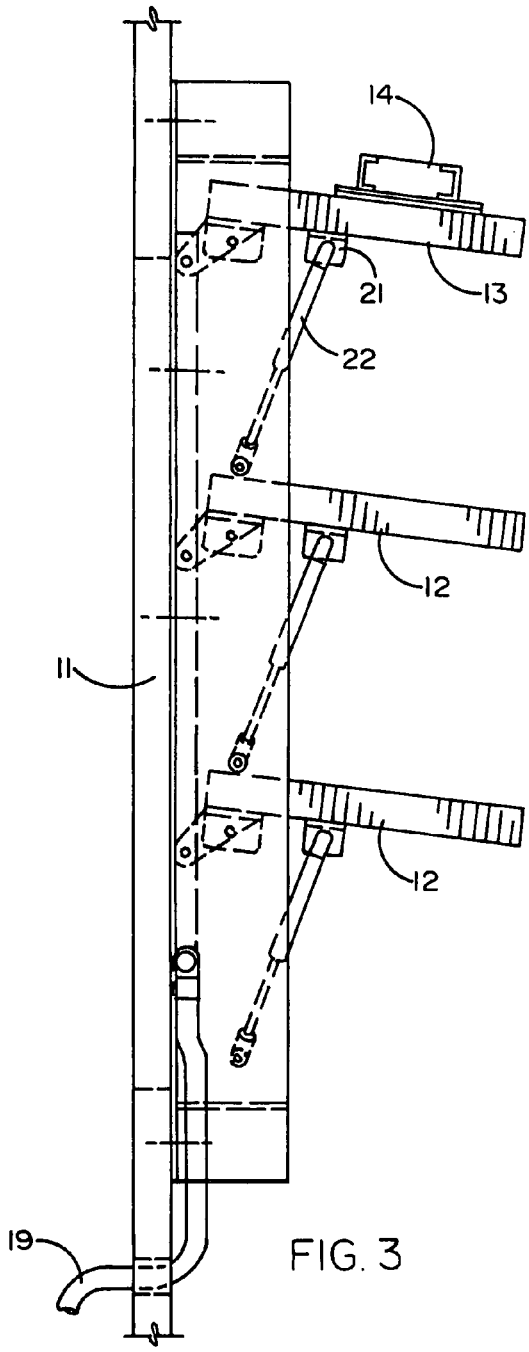
FIG. 3 is a side view in an armor open position.

As shown in FIG. 3, when the panels 12 and 13 are fully elevated into their open position, the existing conventional window is substantially unobstructed and if openable, allows both light and air to enter the vehicle or boat. On the other hand, if as shown in FIG. 4, the panels 12 and 13 are fully lowered into the closed position, the existing conventional window is entirely covered by overlapped opaque armor panels to fully protect the window of the vehicle or boat, but with small armor glass assembly 14 available to provide limited viewing availability.

It will now be understood that what has been disclosed herein comprises a novel adjustable louvered armor window system in which the exterior surface of a conventional window of a vehicle or boat is enclosed by a louvered assembly of opaque ballistic armor panels controlled by a push/pull control cable and rotating rod. The cable is attached to an interior push/pull lever, which can be used to open and close the louvered panels depending upon the threat level. One of the panels preferably has a built in small ballistic glass assembly to permit limited vision through the closed louvered panels. The use of lightweight opaque ballistic armor panels in lieu of ballistic glass for the entire window, permits a significant reduction in weight and permits retention of the existing conventional window which, if openable, permits both light and air to enter the vehicle or boat whenever the threat level is abated.

It will now be apparent that various modifications and additions may be made to the disclosed embodiment without deviating from the principal inventive concepts hereof. Therefore, the scope hereof is to be limited only by the appended claims and their equivalents.

We claim:

1. A ballistic armor assembly for use with windows of vehicles or boats; the assembly comprising:

A plurality of louvered opaque armor solid panels mounted within a frame positioned in juxtaposition to the exterior of a transparent window; the panels being rectangular and having at least one edge attached to brackets for being opened by elevation substantially about said edge into a substantially horizontal position by a control rod affixed to a cable, said cable being controlled by an interior lever adjacent said window and a plurality of gas springs, one such spring connected to each of said panels for assisting in the elevation of said panels by said lever.

2. The ballistic armor assembly recited in claim 1 wherein a selected one of said armor panels comprises a ballistic glass member for permitting visual observation through said panel when said assembly is closed.

* * * * *